US011203509B2

(12) United States Patent
Conrad et al.

(10) Patent No.: US 11,203,509 B2
(45) Date of Patent: Dec. 21, 2021

(54) WRAP DISPENSER

(71) Applicant: Pratt Corrugated Holdings, Inc., Conyers, GA (US)

(72) Inventors: Hannah Conrad, Memphis, TN (US); Corey Crane, Atlanta, GA (US); Travis Walters, Atlanta, GA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 144 days.

(21) Appl. No.: 16/685,520

(22) Filed: Nov. 15, 2019

(65) Prior Publication Data

US 2021/0147174 A1 May 20, 2021

(51) Int. Cl.

| | |
|---|---|
| ***B65H 75/12*** | (2006.01) |
| ***B65H 16/04*** | (2006.01) |
| ***B65H 37/00*** | (2006.01) |

(52) U.S. Cl.

CPC ..... *B65H 75/12* (2013.01); *B65H 16/04* (2013.01); *B65H 37/005* (2013.01); *B65H 2402/412* (2013.01)

(58) Field of Classification Search

CPC ..... B65H 16/005; B65H 75/12; B65H 75/30; B65H 37/005; B65H 16/04; B65H 2402/41; B65H 2402/412; B65H 2801/81; B65H 2701/1752; B65H 23/06; B65H 75/185; B65H 67/085; B65H 35/002; B65B 67/085

See application file for complete search history.

(56) References Cited

U.S. PATENT DOCUMENTS

| | | | |
|---|---|---|---|
| 1,364,259 | A | 1/1921 | Eaton |
| 1,451,914 | A | 4/1923 | Kongsrud |
| 1,935,392 | A | 11/1933 | Coninck |
| 2,331,743 | A | 10/1943 | Sullivan |
| 3,856,229 | A | 12/1974 | Bryam |

(Continued)

FOREIGN PATENT DOCUMENTS

| | | |
|---|---|---|
| DE | 1924348 | 11/1970 |
| DE | 202004011730 | 11/2004 |

(Continued)

OTHER PUBLICATIONS

Walters, Travis; Applicant-Initiated Interview Summary for U.S. Appl. No. 16/365,730, filed Mar. 27, 2019, dated Feb. 23, 2021, 6 pgs.

(Continued)

*Primary Examiner* — William A. Rivera

(74) *Attorney, Agent, or Firm* — Taylor English Duma LLP

(57) ABSTRACT

A dispenser comprising a rotating member and a holding member. The rotating member includes a first portion and a second portion. The first portion has an outer surface and a cylindrical inner surface defining a diameter. The second portion has an outer surface and a cylindrical inner surface defining a diameter. The diameter of the cylindrical inner surface of the second portion is greater than the diameter of the cylindrical inner surface of the first portion. A plurality of ribs extends radially inwardly from the cylindrical inner surface of the second portion. The holding member is located radially outwardly of the first portion. The holding member has an inner surface and an outer surface.

20 Claims, 9 Drawing Sheets

(56) References Cited

U.S. PATENT DOCUMENTS 4,102,513 A 7/1978 Guard
4,166,589 A 9/1979 Hooever et al.
4,179,081 A 12/1979 Parry
4,226,380 A 10/1980 Gay
4,248,392 A 2/1981 Parry
4,339,022 A 7/1982 Hoover
4,372,500 A 2/1983 Saraisky
D268,514 S 4/1983 Thompson
4,477,037 A 10/1984 Goldstein
4,484,717 A 11/1984 Goldstein
4,530,473 A 7/1985 Parry
4,575,020 A 3/1986 Strout et al.
4,600,163 A 7/1986 Hummel et al.
4,659,031 A 4/1987 Saraisky
4,706,442 A 11/1987 Riemenschneider
4,722,493 A 2/1988 Parry et al.
4,752,045 A 6/1988 Goldstein
4,784,348 A 11/1988 Mcdonald
4,817,762 A 4/1989 Powell
4,834,312 A 5/1989 Riemenschneider, III
4,872,623 A 10/1989 Parry et al.
4,874,139 A 10/1989 Kewin
4,971,265 A 11/1990 Koch
5,094,395 A 3/1992 Lambert
5,135,179 A 8/1992 Morano
5,150,852 A 9/1992 Hunt et al.
5,186,376 A 2/1993 Scharf et al.
5,190,237 A 3/1993 Fagan
5,203,517 A 4/1993 Parry et al.
5,310,074 A 5/1994 Jochem et al.
5,351,905 A 10/1994 Ferber
5,398,884 A 3/1995 Stanford
5,409,177 A 4/1995 Parry et al.
5,453,152 A 9/1995 Mazzola et al.
5,490,642 A 2/1996 Schwartz et al.
D371,298 S 7/1996 Reddy et al.
5,573,630 A 11/1996 Edney et al.
5,664,739 A 9/1997 Black et al.
5,868,334 A 2/1999 Cedillo
5,915,642 A 6/1999 Davis
5,927,635 A 7/1999 Black et al.
5,938,142 A 8/1999 Halperin
5,961,063 A 10/1999 Parry
6,015,111 A 1/2000 Berke
6,019,308 A 2/2000 Huang
6,027,069 A 2/2000 Huang
D424,341 S 5/2000 Anderberg
D425,347 S 5/2000 Anderberg
6,102,323 A 8/2000 Riemenschneider
6,227,479 B1 5/2001 Dean et al.
6,227,480 B1 5/2001 Huang
6,398,150 B1 6/2002 Munter et al.
6,405,974 B1 * 6/2002 Herrington ..... B29C 48/21 242/609.4
6,422,499 B1 7/2002 Bernard et al.
6,491,252 B2 12/2002 Komatsu et al.
6,508,430 B1 1/2003 Rodriguez
6,517,023 B2 2/2003 Rodriguez
6,651,918 B2 11/2003 Huang
6,676,069 B1 1/2004 Davis
6,739,542 B1 5/2004 Prina et al.
6,821,638 B2 * 11/2004 Obeshaw ..... B21C 37/15 138/148
6,883,298 B2 4/2005 Gooding et al.
6,892,975 B2 5/2005 Yu Chen
6,905,045 B2 6/2005 Yu Chen
6,926,225 B1 8/2005 Powers
6,997,411 B2 2/2006 Kewin
7,017,743 B1 3/2006 Patterson
7,210,649 B2 5/2007 Yu Chen
7,380,744 B1 6/2008 Yu Chen
7,401,449 B2 7/2008 Watson et al.
7,438,254 B2 10/2008 Oettershagen
D593,464 S 6/2009 Mentis
7,543,426 B1 6/2009 Phero
7,552,891 B2 6/2009 Huang
7,665,686 B2 2/2010 Becker et al.
D612,179 S 3/2010 Huang
7,726,600 B2 6/2010 Huang
7,762,490 B1 7/2010 Yu Chen
7,866,596 B2 1/2011 Yamada
7,900,421 B2 3/2011 Smith
7,937,915 B2 5/2011 Kohn et al.
D649,570 S 11/2011 Chen
8,104,705 B2 1/2012 Yu Chen
8,308,102 B2 11/2012 Lin
8,317,124 B2 11/2012 Yu Chen
8,468,778 B2 6/2013 Windheuser
8,578,683 B2 11/2013 Smith
8,616,490 B2 12/2013 Blok
8,622,332 B2 1/2014 Bologna
8,708,267 B2 4/2014 Morgan
8,783,428 B2 7/2014 Beri
9,010,675 B2 4/2015 Harrison
D738,414 S 9/2015 Chen
9,272,870 B2 3/2016 Stanton
9,284,085 B2 3/2016 Pace
9,481,536 B2 11/2016 Sager et al.
9,688,507 B2 6/2017 Stanton
9,731,932 B2 8/2017 Sager et al.
9,802,722 B1 10/2017 Bison
D810,797 S 2/2018 Love et al.
9,908,656 B2 3/2018 Dahlmann et al.
9,926,093 B2 3/2018 Chen
9,950,896 B2 4/2018 Stanton
9,988,171 B2 6/2018 Dahlmann et al.
D823,905 S 7/2018 Walters et al.
10,087,037 B2 10/2018 Sager et al.
D832,899 S 11/2018 Walters et al.
D833,492 S 11/2018 Stevens et al.
10,150,639 B2 12/2018 Dahlmann et al.
D844,037 S 3/2019 Stevens et al.
10,280,036 B2 5/2019 Stanton
10,287,122 B2 5/2019 Walters et al.
10,494,213 B2 12/2019 Dahlmann et al.
11,040,845 B2 6/2021 Walters et al.
2001/0032904 A1 10/2001 Liu
2002/0070310 A1 6/2002 Liu
2003/0132336 A1 7/2003 Huang
2003/0141406 A1 7/2003 Liu
2004/0065577 A1 4/2004 Yu Chen
2004/0084559 A1 5/2004 Fraser
2004/0134820 A1 7/2004 Katayama
2004/0245282 A1 12/2004 Yu Chen
2005/0124476 A1 6/2005 Kuhl
2005/0168047 A1 8/2005 Grier
2006/0032965 A1 2/2006 Yu Chen
2006/0071118 A1 4/2006 Offerhaus
2006/0175460 A1 8/2006 Hua
2006/0175462 A1 * 8/2006 Becker ..... B65H 16/04 242/588.2
2006/0237577 A1 10/2006 Chen
2006/0278751 A1 12/2006 Chen
2007/0045465 A1 3/2007 Oettershagen
2007/0063092 A1 3/2007 Zevin et al.
2007/0151208 A1 7/2007 Huang
2008/0072538 A1 3/2008 Kohn et al.
2008/0258002 A1 10/2008 Migliaccio
2009/0044494 A1 2/2009 Northrup
2009/0127372 A1 5/2009 Saraisky
2009/0308968 A1 12/2009 Piotrowski et al.
2010/0044491 A1 2/2010 Ritchey et al.
2011/0095122 A1 4/2011 Yu Chen
2011/0095123 A1 * 4/2011 Bologna ..... B65H 75/08 242/422.4
2011/0233321 A1 9/2011 Yu Chen
2011/0284680 A1 11/2011 Lin
2012/0153063 A1 6/2012 Furuichi
2012/0181369 A1 7/2012 Blok
2012/0217336 A1 * 8/2012 Yu Chen ..... B65B 67/085 242/423
2013/0152384 A1 6/2013 Yu Chen
2014/0110616 A1 4/2014 Freeth
2014/0116004 A1 5/2014 Pace

(56) References Cited

U.S. PATENT DOCUMENTS

| | | | | |
|---|---|---|---|---|
| 2014/0188020 | A1 | 7/2014 | Joseph | |
| 2015/0166285 | A1 | 6/2015 | Stanton | |
| 2016/0137454 | A1 | 5/2016 | Stanton | |
| 2016/0221704 | A1 | 8/2016 | Dahlmann | |
| 2016/0264277 | A1 | 9/2016 | Dahlmann | |
| 2016/0355293 | A1 | 12/2016 | Clarke | |
| 2017/0137160 | A1 | 5/2017 | Yu Chen | |
| 2017/0260020 | A1 | 9/2017 | Stanton | |
| 2017/0305621 | A1 | 10/2017 | Miller | |
| 2018/0022565 | A1 | 1/2018 | Dahlmann et al. | |
| 2018/0194590 | A1 | 7/2018 | Stanton | |
| 2018/0257889 | A1 | 9/2018 | Walters et al. | |
| 2018/0362286 | A1* | 12/2018 | Huang | B65H 37/005 |
| 2019/0016549 | A1 | 1/2019 | Dahlmann et al. | |
| 2019/0218050 | A1 | 7/2019 | Walters et al. | |

FOREIGN PATENT DOCUMENTS

| | | |
|---|---|---|
| EP | 0030572 | 6/1981 |
| EP | 0227564 | 7/1987 |
| EP | 0310291 | 4/1989 |
| EP | 0499761 | 8/1992 |
| FR | 2588841 | 5/1988 |
| FR | 2910887 | 12/2009 |
| GB | 2055345 | 3/1981 |
| GB | 2289039 | 11/1995 |
| GB | 2299321 | 10/1996 |
| GB | 2456801 | 7/2009 |
| GB | 2478933 | 9/2011 |
| JP | H0769349 | 3/1995 |
| TW | 201026567 | 7/2010 |
| WO | 1993010006 | 5/1993 |
| WO | 1995000395 | 1/1995 |
| WO | 2007066194 | 6/2007 |

OTHER PUBLICATIONS

Walters, Travis; Notice of Allowance for U.S. Appl. No. 16/365,730, filed Mar. 27, 2019, dated Mar. 10, 2021, 12 pgs.
Stanton, Christopher M.; Non-Final Office Action for U.S. Appl. No. 14/108,881, filed Dec. 17, 2013, dated Sep. 23, 2015, 29 pgs.
Stanton, Christopher M.; Notice of Allowance for U.S. Appl. No. 14/108,881, filed Dec. 17, 2013, dated Nov. 24, 2015, 5 pgs.
Stanton, Christopher M.; Non-Final Office Action for U.S. Appl. No. 15/001,281, filed Jan. 20, 2016, dated Jan. 11, 2017, 44 pgs.
Stanton, Christopher M.; Issue Notification for U.S. Appl. No. 14/108,881, filed Dec. 17, 2013, mailed Feb. 10, 2016, 1 pg.
Stanton, Christopher M.; Issue Notification for U.S. Appl. No. 15/001,281, filed Jan. 20, 2016, mailed Jun. 7, 2017, 1 page.
Stanton, Christopher M.; Notice of Allowability for U.S. Appl. No. 15/001,281, filed Jan. 20, 2016, dated Apr. 26, 2017, 6 pgs.
Stanton, Christopher M.; Notice of Allowance for U.S. Appl. No. 15/001,281, filed Jan. 20, 2016, dated Mar. 8, 2017, 5 pgs.
Stanton, Christopher M.; Issue Notification for U.S. Appl. No. 15/606,361, filed May 26, 2017, mailed Jan. 4, 2018, 1 pg.
Stanton, Christopher M.; Notice of Allowance for U.S. Appl. No. 15/606,361, filed May 26, 2017, dated Dec. 14, 2017, 30 pgs.
Stanton, Christopher M.; Supplemental Notice of Allowance for U.S. Appl. No. 15/606,361, filed May 26, 2017, dated Jan. 16, 2018, 6 pgs.
Stanton, Christopher M.; Supplemental Notice of Allowance for U.S. Appl. No. 15/606,361, filed May 26, 2017, dated Dec. 28, 2017, 4 pgs.
Stanton, Christopher M.; Supplemental Notice of Allowance for U.S. Appl. No. 15/606,361, filed May 26, 2017, dated Mar. 22, 2018, 6 pgs.
Stanton, Christopher M.; Issue Notification for U.S. Appl. No. 15/916,992, filed Mar. 9, 2018, mailed Apr. 17, 2019, 1 pg.
Stanton, Christopher M.; Non-Final Office Action for U.S. Appl. No. 15/916,992, filed Mar. 9, 2018, dated May 16, 2018, 25 pgs.
Stanton, Christopher M.; Notice of Allowance for U.S. Appl. No. 15/916,992, filed Mar. 9, 2018, dated Nov. 1, 2018, 16 pgs.
Stanton, Christopher M.; Supplemental Notice of Allowance for U.S. Appl. No. 15/916,992, filed Mar. 9, 2018, dated Nov. 21, 2018, 7 pgs.
Stanton, Christopher M.; Supplemental Notice of Allowance for U.S. Appl. No. 15/916,992, filed Mar. 9, 2018, dated Nov. 8, 2018, 2 pgs.
Dahlmann, Deborah A.; Advisory Action for U.S. Appl. No. 14/609,567, filed Jan. 30, 2015, dated Jan. 24, 2017, 4 pgs.
Dahlmann, Deborah A.; Final Office Action for U.S. Appl. No. 14/609,567, filed Jan. 30, 2015, dated Oct. 20, 2016; 11 pgs.
Dahlmann, Deborah A.; Issue Notification for U.S. Appl. No. 14/609,567, filed Jan. 30, 2015, mailed Feb. 14, 2018, 1 pg.
Dahlmann, Deborah A.; Non-Final Office Action for U.S. Appl. No. 14/609,567, filed Jan. 30, 2015, dated Jun. 16, 2016, 38 pgs.
Dahlmann, Deborah A.; Notice of Allowance for U.S. Appl. No. 14/609,567, filed Jan. 30, 2015, dated Jul. 6, 2017, 17 pgs.
Dahlmann, Deborah A.; Issue Notification for U.S. Appl. No. 14/642,940, filed Mar. 10, 2015, mailed May 16, 2018, 1 pg.
Dahlmann, Deborah A.; Non-Final Office Action for U.S. Appl. No. 14/642,940, filed Mar. 10, 2015, dated Oct. 11, 2017, 48 pgs.
Dahlmann, Deborah A.; Notice of Allowance for U.S. Appl. No. 14/642,940, filed Mar. 10, 2015, dated Apr. 2, 2018, 9 pgs.
Dahlmann, Deborah A.; Supplemental Notice of Allowance for U.S. Appl. No. 14/642,940, filed Mar. 10, 2015, dated Apr. 13, 2018, 6 pgs.
Dahlmann, Deborah; Supplemental Notice of Allowance for U.S. Appl. No. 14/642,940, filed Mar. 10, 2015, dated May 9, 2018, 6 pgs.
Dahlmann, Deborah A.; Issue Notification for U.S. Appl. No. 15/215,025, filed Jul. 20, 2016, mailed Oct. 10, 2018, 1 pg.
Dahlmann, Deborah A.; Issue Notification for U.S. Appl. No. 15/215,025, filed Jul. 20, 2016, mailed Nov. 20, 2018, 1 pg.
Dahlmann, Deborah A.; Supplemental Notice of Allowance for U.S. Appl. No. 15/215,025, filed Jul. 20, 2016, dated Aug. 29, 2018, 6 pgs.
Dahlmann, Deborah A.; Supplemental Notice of Allowance for U.S. Appl. No. 15/215,025, filed Jul. 20, 2016, dated Sep. 27, 2018, 6 pgs.
Dahlmann, Deborah; Non-Final Office Action for U.S. Appl. No. 15/215,025, filed Jul. 20, 2016, dated Apr. 30, 2018, 49 pgs.
Dahlmann, Deborah; Notice of Allowance for U.S. Appl. No. 15/215,025, filed Jul. 20, 2016, dated Jun. 26, 2018, 10 pgs.
Dahlmann, Deborah; Supplemental Notice of Allowance for U.S. Appl. No. 15/215,025, filed Jul. 20, 2016, dated Nov. 6, 2018, 7 pgs.
Dahlmann, Deborah A.; Non-Final Office Action for U.S. Appl. No. 16/135,743, filed Sep. 19, 2018, dated Oct. 30, 2018, 28 pgs.
Dahlmann, Deborah A.; Notice of Allowance for U.S. Appl. No. 16/135,743, filed Sep. 19, 2018, dated Sep. 23, 2019, 19 pgs.
Dahlmann, Deborah A.; Supplemental Notice of Allowance for U.S. Appl. No. 16/135,743, filed Sep. 19, 2018, dated Oct. 17, 2019, 6 pgs.
Walters, Travis; Issue Notification for U.S. Appl. No. 15/454,415, filed Mar. 9, 2017, mailed Apr. 24, 2019, 1 pg.
Walters, Travis; Non-Final Office Action for U.S. Appl. No. 15/454,415, filed Mar. 9, 2017, dated Oct. 5, 2018, 52 pgs.
Walters, Travis; Notice of Allowance for U.S. Appl. No. 15/454,415, filed Mar. 9, 2017, dated Jan. 7, 2019, 12 pgs.
Walters, Travis; Supplemental Notice of Allowance for U.S. Appl. No. 15/454,415, filed Mar. 9, 2017, dated Feb. 22, 2019, 6 pgs.
Amazon.com; Article entitled: "Goodwrappers VSR PRD15005 Linear Low Density Polyethylene Clear Cast Hand Stretch Wrap with 1 Reusable Dispenser and Hand Brake, 650' Length x 5" Width x 150 Gauge Thick (Case of 12)", publicly available prior to Apr. 12, 2019, 5 pgs.
American Paper & Twine Co.; Article entitled: Classic Films Hand Stretch Banding Bundling Film, publicly available prior to Apr. 12, 2019, 2 pgs.
Medwest Inc; Article entitled: "Flex-i-Wrap", publicly available prior to Apr. 12, 2019, 4 pgs.
MIPAQ; Article entitled: "W810—Hand wrap dispenser for 100mm Stretch Wrap", publicly available prior to Apr. 12, 2019, 2 pgs.

(56) References Cited

OTHER PUBLICATIONS

Walmart.com; Article entitled: "Hand Stretch Wrap, Red, 1000 ft. L, 3 in W, PK415A903", publicly available prior to Apr. 12, 2019, 5 pgs.
Walters, Travis; Issue Notification for Design U.S. Appl. No. 29/596,584, filed Mar. 9, 2017, mailed Jul. 4, 2018, 1 pg.
Walters, Travis; Notice of Allowance for U.S. Appl. No. 29/596,584, filed Mar. 9, 2017, dated May 7, 2018, 40 pgs.
Walters, Travis; Supplemental Notice of Allowability for Design U.S. Appl. No. 29/596,584, filed Mar. 9, 2017, dated Jun. 25, 2018, 8 pgs.
Walters, Travis; Issue Notification for U.S. Appl. No. 29/649,781, filed Jun. 1, 2018, mailed Oct. 17, 2018, 1 pg.
Walters, Travis; Non-Final Office Action for U.S. Appl. No. 16/365,730, filed Mar. 27, 2019, dated Dec. 3, 2020, 44 pgs.
Goodwrappers; "Unitization products by Goodwrappers, include hand wrappers, replacement rolls, core handwrap, generic and disposable hand wrap", Apr. 7, 2010, located at <https://web.archive.org/web/20100407080537/http:/www.goodwrappers.com/prod_unit.asp>, 4 pgs.
Vestil Manufacturing; "Stretch Wrap Dispensers", located at <http://www.vestilmfg.com/products/mhequip/stretch_wrap_dispensers.htm>, Copyright 2014, accessed on Aug. 11, 2014, 2 pgs.
Images of Braking Wrap Film Dispenser, publicly available prior to Dec. 17, 2012, 12 pgs.
""Stretch film—BK Holder" www.benkaico.comhttp://www.benkaico.com/product-area/stretch-film—bk-holder (Accessed Jun. 10, 2013), 2 pgs.".
""Stretch Film Dispenser—Hand Core Insert 3" www.aaabalingandstrapping.com http://www.aaabalingandstrapping.com/index.php?main_page=product_info&c Path=8&products_id=183&zenid=3tkfdrfajbi8ha9ducbdvfclv4 (Accessed Jun. 10, 2013), 2 pgs.".
""Hand Savers Stretch Wrap Film Hand Dispenser" www.ebay.comhttp://www.ebay.com/itm/Hand-Savers-Stretch-Wrap-Film-Hand-Dispenser-1- set-/251286375179 (Accessed Jun. 10, 2013), 3 pgs.".
Walters, Travis; Supplemental Notice of Allowance for Design U.S. Appl. No. 29/649,781, filed Jun. 1, 2018, dated Sep. 24, 2018, 7 pgs.
Walters, Travis; Supplemental Notice of Allowance for U.S. Appl. No. 29/649,781, filed Jun. 1, 2018, dated Sep. 10, 2018, 3 pgs.
Walters, Travis; Notice of Allowance for Design U.S. Appl. No. 29/649,781, filed Jun. 1, 2018, dated Aug. 31, 2018, 29 pgs.

* cited by examiner

WRAP DISPENSER

TECHNICAL FIELD

This disclosure relates to wrap dispensers. More specifically, this disclosure relates to wrap dispensers that allow an operator to dispense rolls of film or other wrap while holding onto the wrap dispenser.

BACKGROUND

Plastic or other sheets of material are sometimes used to wrap items for transport, storage, or other various reasons. For one example among others, wraps can comprise thin plastic films, membranes, or sheets of any suitable material and are often rolled around a cylindrical paperboard core or other similar devices such as a spool made of another material that allows the wrap to be dispensed to facilitate the wrapping of items. This can protect the items from dust, water, and other contaminants found in the environment and can hold the items together. Types of plastic wraps can comprise plastic stretch wrap, which is commonly rolled around a paperboard core and used to secure and protect items during a move, such as wrapping furniture or bundling objects together. In many situations, this dispensing is done manually. Accordingly, it is desirable that the method of dispensing wrap is done in a safe but efficient manner.

SUMMARY

Disclosed is a dispenser comprising a rotating member including a first portion and a second portion, the first portion having an outer surface and a cylindrical inner surface defining a diameter, the second portion having an outer surface and a cylindrical inner surface defining a diameter, the diameter of the cylindrical inner surface of the second portion is greater than the diameter of the cylindrical inner surface of the first portion, a plurality of ribs extends radially inwardly from the cylindrical inner surface of the second portion; and a holding member located radially outwardly of the first portion, the holding member having an inner surface and an outer surface.

Also disclosed is a dispenser comprising a rotating member including a first portion having an outer surface and a cylindrical inner surface defining a diameter, a second portion having an outer surface and a cylindrical inner surface defining a diameter, the diameter of the cylindrical inner surface of the second portion is greater than the diameter of the cylindrical inner surface of the first portion, a third portion having a conical outer surface and an inner surface, a plurality of ribs extends radially inwardly from inner surfaces of the second and third portions; and a roll of wrap located radially outwardly of the outer surface of the second portion.

Also disclosed is a method of assembling a wrap dispenser comprising the steps of providing a rotating member including a first portion and a second portion, the first portion having an outer surface and a cylindrical inner surface defining a diameter, the second portion having an outer surface and a cylindrical inner surface defining a diameter, the diameter of the cylindrical inner surface of the second portion is greater than the diameter of the cylindrical inner surface of the first portion, a plurality of ribs extends radially inwardly from the cylindrical inner surface of the second portion; providing a holding member having an inner surface, an outer surface and an opening; and inserting the first portion of the rotating member through the opening of the holding member.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1:
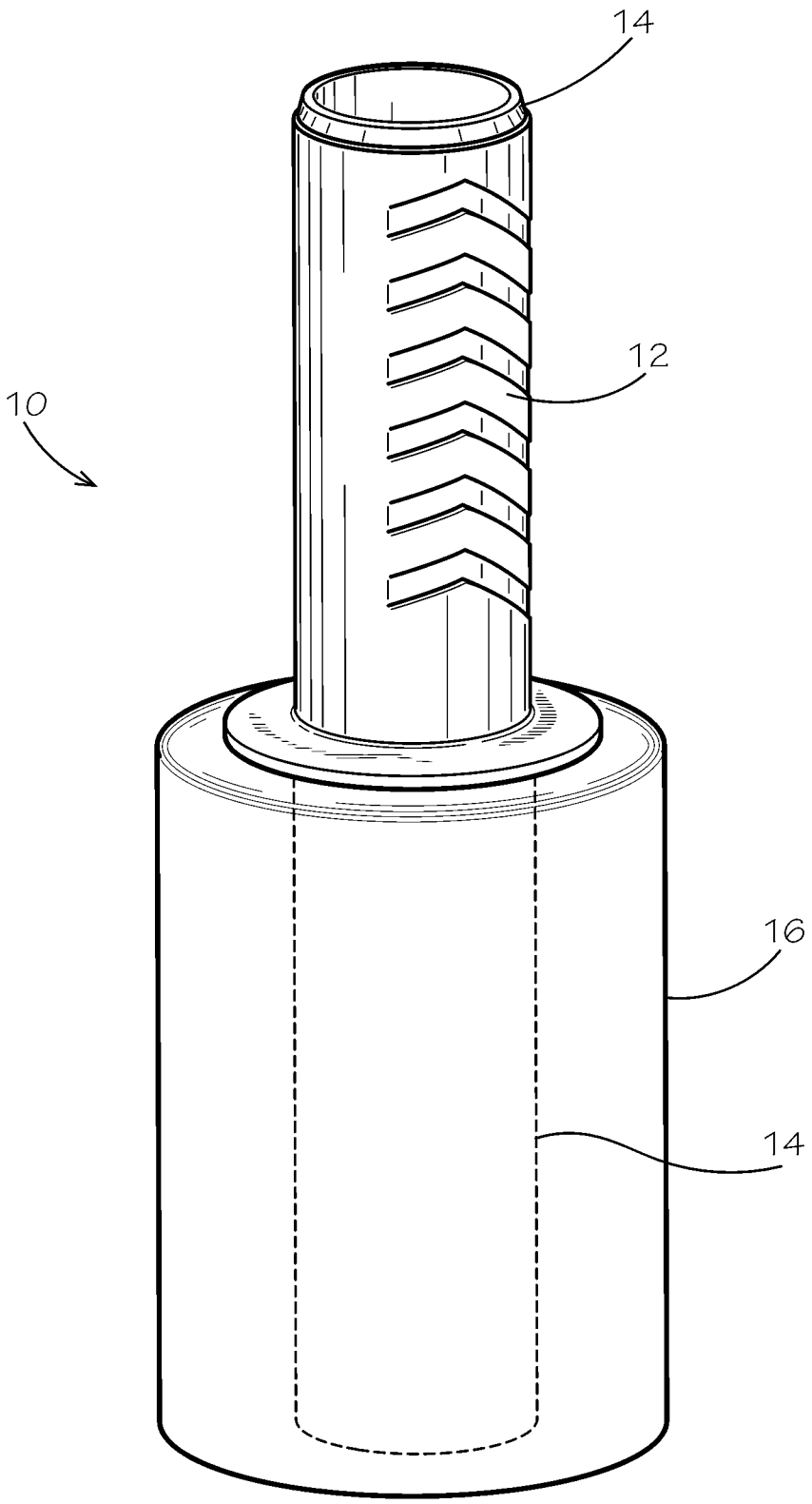
FIG. 1 is a perspective view of a wrap dispenser according to a first aspect of the present disclosure including a holding member, a rotating member and a roll of wrap.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in their best, currently known aspects. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can comprise two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

For purposes of the current disclosure, comparison of two dimensions, including but not limited to lengths, thicknesses and diameters, having "equal" to, "greater" than or "less" than dimensions are directed to the intended design dimensions and can vary within a range of manufacturing, industry accepted or industry-standard tolerances for each dimension.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "can," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or Steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is a wrap dispenser and associated methods, systems, devices, and various apparatus. In various aspects, the dispenser includes at least one holding member and one rotating member that are joined in a rotatable fashion so that the rotating member may rotate while wrapped with wrap while the user holds the holding member. The terms "holding member" and "rotating member" may include any member that allows a user to, respectively, hold the holding member in the user's hand and allow the rotating member to freely rotate relative to the holding member. Furthermore, the term "wrap" should be interpreted broadly and should be applied to any material that is used to cover or protect objects, including but not limited to stretch wrap, film, bubble wrap, tape, foil, tissue paper, or wrapping paper. While it is particularly useful in applications for dispensing plastic film, sheets, or other wraps, it should not be so limited as it could be used with other dispensing operations or with other materials of any desired thickness that is used to cover, enclose, enwrap, or otherwise protect articles. It would be understood by one of skill in the art that the disclosed dispenser is described in but a few exemplary aspects among many. No particular terminology or description should be considered on the disclosure or the scope of any claims issuing therefrom.

Figure 2:
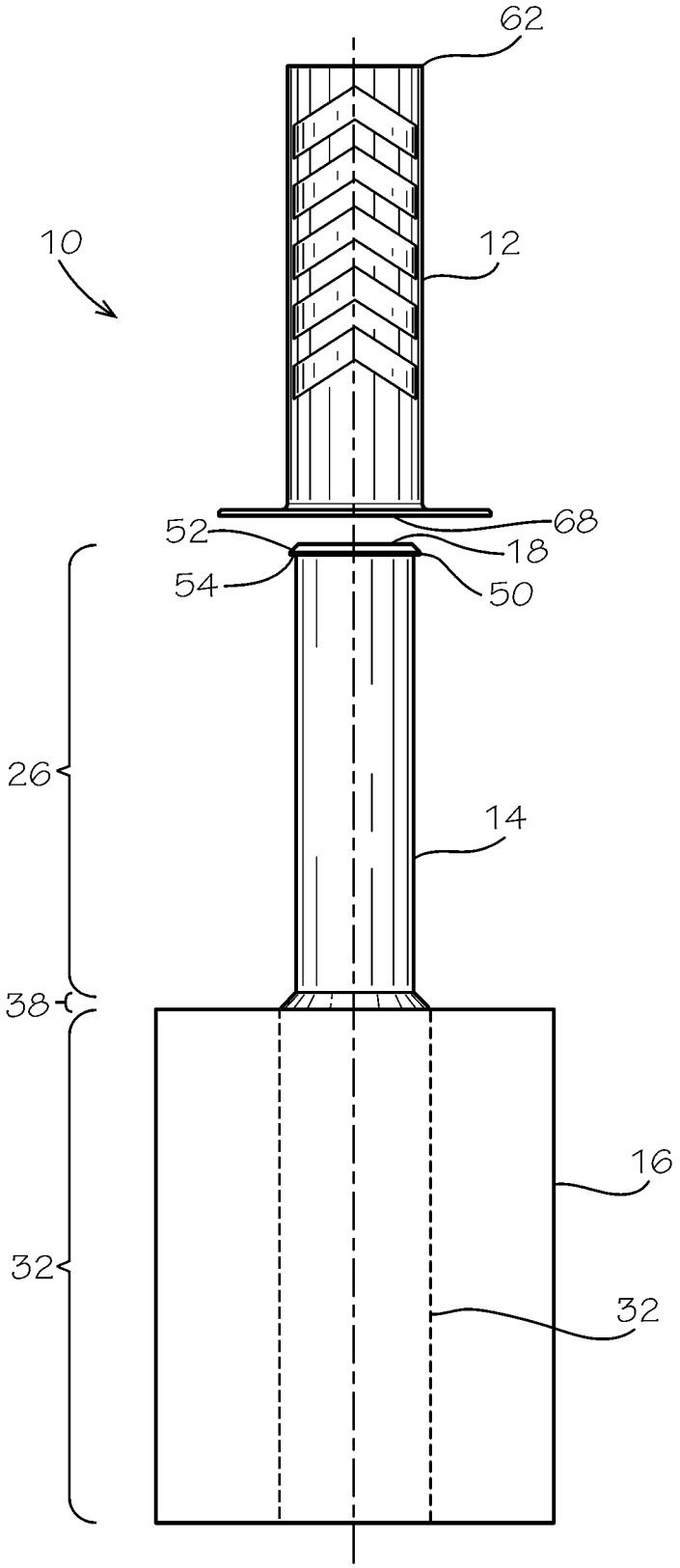
FIG. 2 is an exploded assembly view of the wrap dispenser of FIG. 1 showing how the rotating member and holding member are assembled.

One aspect of a wrap dispenser 10 is shown in FIG. 1. The wrap dispenser 10 can comprise a holding member 12 and a rotating member 14 having a roll of wrap 16 positioned over at least a part of the rotating member 14. In various aspects, the wrap 16 is rolled around the rotating member 14 to create the roll of wrap 16 shown in FIG. 1. The rotating member 14 is thereby a spool around which the wrap 16 is rolled. In various aspects, the rotating member 14 and holding member 12 are comprised of substantially annular or tubular portions, though other shapes may be present in various aspects As shown in FIG. 2, in the current aspect, the wrap dispenser 10 includes the holding member 12 and the rotating member 14 having a roll of wrap 16. The holding member 12, the rotating member 14 and the method of installing the holding member 12 onto the rotating member will be discussed in detail below.

Figure 3:
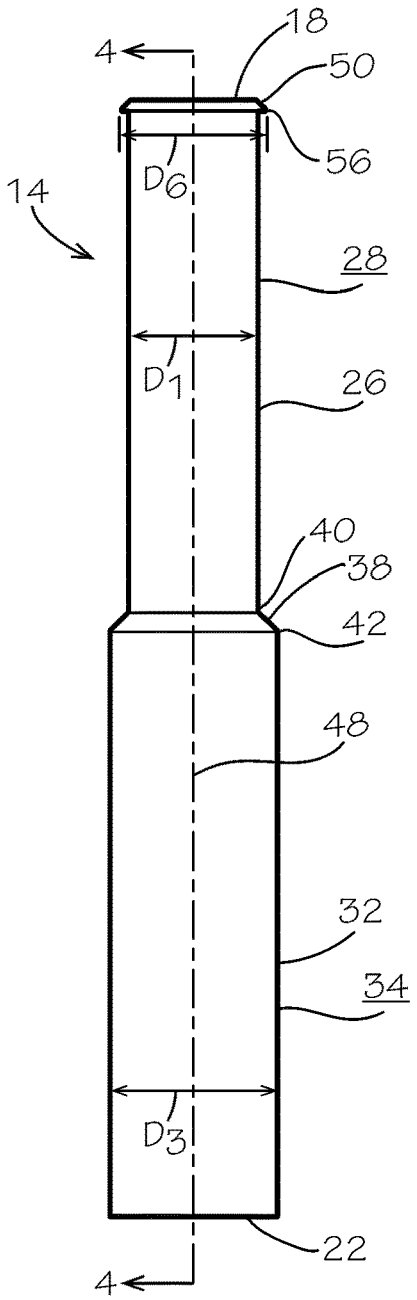
FIG. 3 is a side view of the rotating member of the wrap dispenser of FIG. 1.
Figure 4:
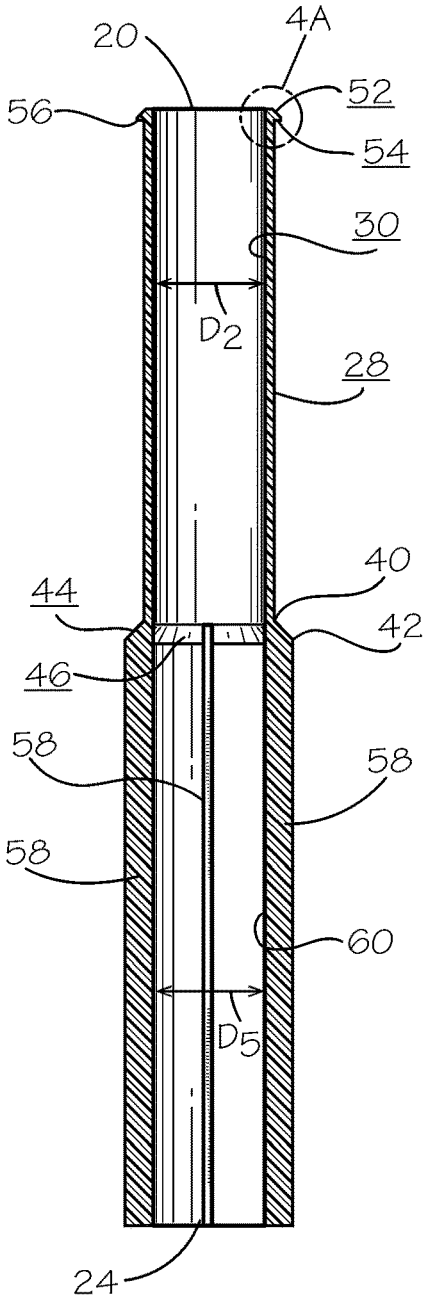
FIG. 4 is a cross-sectional view of the rotating member of FIG. 3 taken along line 4-4.
Figure 5:
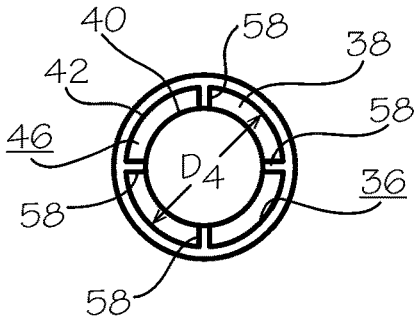
FIG. 5 is a bottom view of the rotating member of FIG. 3.

As shown in FIGS. 3-5, the rotating member 14 has a first end 18 defining a first opening 20 and a second end 22 defining a second opening 24 as well as an engaging portion 26, a roll-holding portion 32 and a transition portion 38 located longitudinally in between the engaging portion 26 and the roll-holding portion 32. The first end 18 of the rotating member 14 of the present aspect defines a continuous unbroken circle and the second end 22 defines a continuous unbroken circle. In various aspects, the rotating member 14 is formed from a plastic material. In other various aspects, the rotating member can be formed from other rigid or semi-rigid materials, such as cast iron, steel, aluminum, titanium, copper, brass, resins, composites, or any material of sufficient strength to withstand the loads placed on it when dispensing film, or any combination of the foregoing materials.

The rotating member 14 has a longitudinal axis which is the axis of rotation 48 that extends from its first end 18 to its second end 22. The engaging portion 26 has a substantially annular or tubular configuration with a cylindrical outer surface 28 defining an outer diameter $D_1$ and a cylindrical inner surface 30 defining an inner diameter $D_2$. The roll-holding portion 32 has a substantially annular or tubular configuration with a cylindrical outer surface 34 defining an outer diameter $D_3$ and a cylindrical inner surface 36 (shown in FIG. 5) defining an inner diameter $D_4$. The transition portion 38 has a first end 40 and a second end 42 and is longitudinally situated in between the engaging portion 26 and the roll-holding portion 32. The transition portion has a conical outer surface 44 with an outer diameter at the first end 40 equal to the outer diameter $D_1$ of the engaging portion 26 and an outer diameter at the second end 42 equal to the outer diameter $D_3$ of the roll-holding portion 32. The transition portion has a conical inner surface 46 (shown in FIGS. 4 and 5) with an inner diameter at the first end 40 equal to the inner diameter $D_2$ of the engaging portion 26 and an inner diameter at the second end 42 equal to the inner diameter $D_4$ of the roll-holding portion 32.

In various aspects, the roll-holding portion 32 of the rotating member 14 is substantially cylindrical and the outer surface 34 of the roll-holding portion 32 has a smooth surface. In various other aspects, the roll-holding portion 32 of the rotating member 14 includes at least one roll grip (not shown) on the outer surface 34. In these other aspects, the at least one roll grip is a rib or a raised surface protruding radially outwardly from the outer surface 34 on the roll-holding portion 32 of the rotating member 14. In these other aspects, the at least one roll grip engages the inside of the roll of wrap 16 in a frictionally desirable manner to help keep the roll of wrap 16 from sliding off and/or rotate independently of the rotating member 14.

Figure 4A:
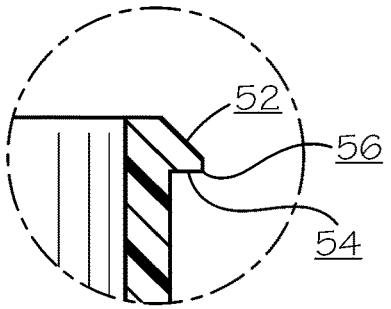
FIG. 4A is an enlarged view of portion 4A circled in FIG. 4.

The engaging portion 26 includes an upset 50 protruding radially outwardly from the cylindrical outer surface 28 of the engaging portion adjacent to the first end 18 of the rotating member 14. The upset 50 of the present aspect is circumferentially continuous or defines a continuous unbroken circle (e.g., not having a slot, cut or other opening breaking the continuous circular upset). The upset 50 has a chamfered surface 52 and a flat annular surface 54 (shown in FIGS. 4 and 4A) substantially perpendicular to the cylindrical outer surface 28 of the engaging portion 26. The upset 50 has a radially outermost edge 56 at the intersection of chamfered surface 52 and the annular surface 54. The radially outermost edge 56 of the upset 50 has a diameter $D_6$. In various aspects, the upset 50 is monolithically formed with the remainder of the engaging portion 26. Alternatively, in various other aspects, the upset can be a separately formed piece attached or otherwise connected to the remainder of the engaging portion 26 with mechanisms including, but not limited to, welding, adhesives, glues, fasteners, or various other attachment mechanisms.

The rotating member 14 also has four substantially equally spaced ribs 58 (shown in FIGS. 4 and 5) extending radially inwardly from the cylindrical inner surface 36 (shown in FIG. 5) of the roll-holding portion 32 and the conical inner surface 46 of the transition portion 38. Each rib 58 has a radially inward edge 60 (shown in FIG. 4) that is substantially parallel to the longitudinal axis 48 of the rotating member 12. In various aspects, the radially inward edges 60 of the ribs 58 define a diameter $D_5$ equal to the inner diameter $D_2$ of the engaging portion 26, such that the smooth transition from the inner surface 30 of engaging portion 26 to the radially inward edges 60 of the ribs 58 minimalizes potential stress failures or cracks being formed at the transition. Furthermore, having the diameter $D_5$ of radially inward edges 60 of the ribs 58 equal to the inner diameter $D_2$ of the engaging portion 26 allows efficient molding of the rotating member by permitting the core of a die to be removed longitudinally along the axis 48 of the rotating member 14 through its second opening 24.

As shown in FIGS. 1 and 2, the wrap dispenser 10 includes the holding member 12, which is configured to slide onto the engaging portion 26 of the rotating member 14 in the assembled dispenser 10. In various aspects, the holding member 12 is formed from a plastic material. In other various aspects, the rotating member can be formed from other semi-rigid materials, such as a rubber-like material, polyethylene foam or any material flexible and resilient enough to allow compression of the holding member 12 to frictionally engage the rotating member 14, or any combination of the foregoing materials.

Figure 6:
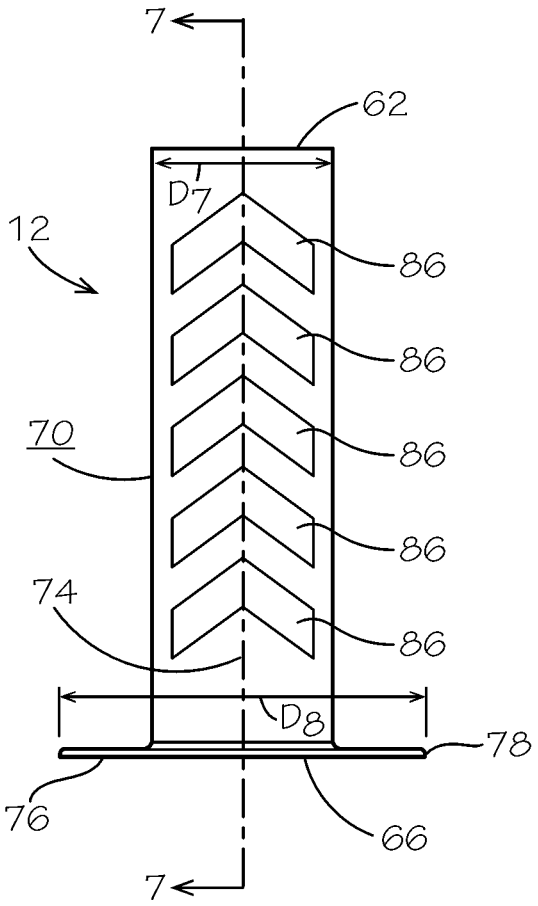
FIG. 6 is a side view of the holding member of FIG. 1.
Figure 7:
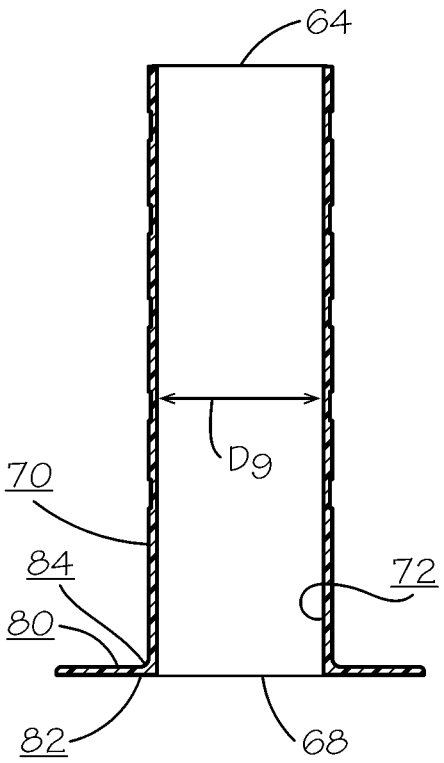
FIG. 7 is a cross-sectional view of the holding member of FIG. 6 taken along line 7-7.
Figure 8:
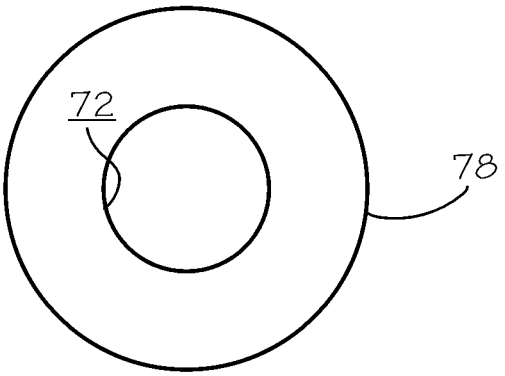
FIG. 8 is a bottom view of the holding member of FIG. 6.

As shown in FIGS. 6-8, the holding member 12 has a first end 62 defining a first opening 64 and a second end 66 defining a second opening 68. The holding member 12 has a substantially cylindrical outer holding surface 70 that a user may hold, grab, or clench when using the wrap dispenser 10 to dispense wrap 16 (shown in FIGS. 1 and 2) such as film. The holding member 12 has a substantially annular or tubular configuration with a longitudinal axis 74 that extends from its first end 62 to its second end 66. The holding member 12 includes a cylindrical outer holding surface 70 and a cylindrical inner surface 72. As shown in FIG. 6, the outer holding surface 70 defines a diameter $D_7$. In various aspects, the first end 62 of the holding member 12 defines a continuous unbroken circle and the second end 66 of the holding member 12 defines a continuous unbroken circle.

In various aspects, the holding member 12 also includes a flange 76 extending radially outwardly from the cylindrical outer surface 70 adjacent to the second end 66. The flange 76 may have an annular shape with a thickness along the longitudinal axis 74 and may extend radially outwardly in a direction that is substantially perpendicular to the longitudinal axis 74 to give the flange 76 a diameter that is greater than a diameter of the first end 62. In various other aspects, the flange may be positioned at an intermediary position between the first end 62 and the second end 66. The location of the flange 76 should not be considered limiting unless specifically recited in a claim. When a user is holding the holding member 12, the flange 76 can protect the user's hand from the spinning roll of wrap 16 when the wrap is being dispensed. In various aspects, the flange 76 is monolithically formed with the holding member 12; however in various other aspects, the flange 76 is attached or otherwise connected to the holding member 12 with mechanisms including, but not limited to, welding, adhesives, glues, fasteners, or various other attachment mechanisms. In the present aspect, the flange 76 has an annular shape. In various aspects, the flange 76 defines a continuous unbroken circle. In various other aspects, the flange 76 may have a shape that is square, oval, angled, or have any other desired shape. The shape of the flange 76 should not be considered limiting on the current disclosure unless specifically recited in a claim.

The flange 76 extends radially outwardly from the outer holding surface 70 in a direction that is substantially perpendicular to the axis 74 of the holding member 12 to give the radially outward rim 78 of the flange 76 a diameter $D_8$ that is greater than the diameter $D_7$ of the outer holding surface 70. The flange 76 has a first surface 80 and a second surface 82. The first surface 80 of the flange 76 faces toward the remainder of the holding member 12. An inward curved or rounded transition surface 84 transitions the first surface 80 to the outer holding surface 70. The second surface 82 of the flange 76 faces away from the remainder of the holding member 12 and toward the roll of wrap 16 upon the wrap dispenser 10 fully assembled. In various aspects, the first surface 80 is a flat annular surface perpendicular to the longitudinal axis 74 of the holding member 12; however, in various other aspects, the first surface 80 can be angled, curved, or have any other desired shape. The shape of the first surface 80 should not be considered limiting on the current disclosure unless specifically recited in a claim. In various aspects, the second surface 82 is a flat annular surface perpendicular to the longitudinal axis 74 of the holding member 12; however, in various other aspects, the second surface 82 can be angled, curved, or have any other desired edge shape. The shape of the second surface 82 should not be considered limiting on the current disclosure unless specifically recited in a claim.

In various aspects, the holding member 12 has a plurality of indentions 86 formed on the outer holding surface 70. The indentions 86 provide a decorative design and also minimalizes slippage between the user's hand and the holding member 12. As previously described, the user may hold, grab, or clench the outer holding surface 70 when using the wrap dispenser 10 to dispense wrap 16, such as film. The indentions 86 allow the user to have a firmer grip on the outer holding surface; in particular, when the user's hand and/or the outer holding surface 70 is wet. The indentions 86 can be formed during the molding process of the holding member 12 or the indentions can be formed after the holding member 12 has been molded, such as by embossing, melting or cutting the outer holding surface 70. In various aspects, the holding member 12 has five chevron shaped indentions 86 on each of the two sides of the outer holding surface 70 for a total of ten chevron shaped indentions 86 formed on the outer holding surface 70. A user may place his or her fingers in the chevron shaped indentions 86, if so desired, for better grip when holding the holding member 12. In various other aspects, the indentions may have a design other than a chevon shape and the number of the indentions may be other than ten. The design and the number of indications formed on the outer holding surface should not be considered limiting on the current disclosure unless specifically recited in a claim.

As shown in FIG. 7, the inner surface 72 of the holding member 12 defines a diameter $D_9$, which is greater than outer diameter $D_1$ (shown in FIG. 3) of the engaging portion 26, less than the outer diameter $D_3$ (shown in FIG. 3) of the roll-holding portion 32, and less than the diameter $D_6$ (shown in FIG. 3) of the radially outermost edge 56 of the upset 50. In the present aspect, the inner surface 72 of the holding member 12 is substantially cylindrical. In the aspect shown, the diameter $D_9$ of the inner surface 72 of the holding member 12 is greater than the outer diameter $D_1$ of the outer surface 28 of the engaging portion 26 to provide clearance for the rotating member 14 to smoothly rotate relative to the holding member 12 when no substantial compression (or radially inward force) is applied to the holding member 12.

In various aspects, the inner surface 72 of the holding member 12 can frictionally engage the outer surface 28 the engaging portion 26 of the rotating member 14 upon compression of (or radially inward force applied to) the holding member 12. In various other aspects, the holding member 12 can include additional structures (not shown) protruding radially inwardly from the inner surface 72. These structures may include nubs, circumferential ridges, longitudinal ridges, teeth, or similar protrusions configured to enhance the friction produced when compressing the holding member 12 to engage the engaging portion 26 of the rotating member 14.

Referring back to FIG. 2, a method of assembling the wrap dispenser 10 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A holding member 12, a rotating member 14, and a wrap 16 are provided. In various aspects, the wrap 16 is wrapped directly around roll-holding portion 32 of the rotating member 14 to form the roll of wrap 16 positioned on the roll-holding portion 32.

In other various aspects, the wrap 16 is wrapped around a cylindrical sleeve (not shown) and the cylindrical sleeve and the wrap are then positioned over the roll-holding portion 32 of the rotating member such that inner surface of the cylindrical sleeve engages the outer surface 34 of the roll-holding member in a manner that the cylindrical sleeve and wrap rotate with the rotating member 14. For such other various aspects, the outer surface of the roll-holding member may include radially extending ribs (not shown) to fit into corresponding grooves (not shown) formed on the inner surface of the cylindrical sleeve, or some other rotational locking component(s), to rotationally engage the cylindrical sleeve and wrap to the roll-holding member of the rotating member. The cylindrical sleeve can be formed of a rigid or semi-rigid material, such as plastic or paper. The use of a wrap dispenser with the wrap wrapped around a cylindrical sleeve allows the user to reuse the wrap dispenser, after the original roll of wrap has been exhausted, by removing the original cylindrical sleeve and installing another cylindrical sleeve with wrap wrapped around the cylindrical sleeve.

The holding member 12 is positioned on engaging portion 26 of the rotating member 14 by inserting the engaging portion 26 of the rotating member 14 into and through the second opening 68 of the holding member 12 and further sliding the holding member 12 over the upset 50 of the engaging portion 26. Since the diameter $D_6$ (shown in FIG. 3) of the radially outermost edge 56 of the upset 50 is greater than the diameter $D_9$ (shown in FIG. 7) of the inner surface 72 of the holding member 12, the holding member 12 will need to expand and stretch radially outwardly as it slides along the upset 50. The chamfered surface 52 of the upset 50 guides the expansion or stretching of the holding member 12 radially outwardly as the holding member 12 slides laterally along the chamfered surface 52. Once the holding member 12 has slid past the upset 50, the holding member 12 contracts back to a diameter that is smaller than the diameter $D_6$ of the radially outermost edge 56 of the upset 50. In its installed position, wherein the first end 62 of the holding member 12 slid past the upset 50, the holding member 12 is laterally situated between the transition portion 38 of the rotating member 14 and the upset 50. Since the first end 62 of the holding member 12 now faces the flat annular surface 54 of the upset 50, rather than a chamfered surface, the holding member 12 is not able to slide over the upset 50 in the same manner as it was able to slide over the chamfered surface 52 during installation.

In the installed position, the holding member 12 encloses at least a section of the engaging portion 26 of the rotating member 14 and the longitudinal axis 74 (shown in FIG. 6) of the holding member 12 is substantially aligned with the longitudinal axis 48 (shown in FIG. 3) of the rotating member 14. Furthermore, when the holding member 12 is fully installed onto the rotating member 14, the flange 76 at the second end 66 of the holding member is adjacent to the roll of wrap 16.

Focusing now on FIG. 9, a method of dispensing wrap 16 using a wrap dispenser 10 will be described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A user 100 first obtains a wrap dispenser 10 which includes a rotating member 14 with wrap 16 wrapped around the rotating member 14, and a holding member 12 installed on the engaging portion 26 of the rotating member 14.

The user 100 holds and grips the outer holding surface 70 of the holding member 12 and begins dispensing the wrap 16 with the flange 76 separating and protecting the user's hand from the spinning roll of wrap 16. Although the user 100 is holding the holding member 12, the rotating member 14 freely rotates around its axis of rotation 48 to dispense the wrap 16 because the inner surface 72 (shown in FIG. 7) of the holding member 12 is not substantially compressed against the outer surface 28 (shown in FIG. 3) of the engaging portion 26 of the rotating member 14. The inner surface 72 of the holding member 12 and outer surface 28 of the engaging portion 26 are sufficiently smooth in the current aspect such that the friction between the inner surface 72 and outer surface 28 does not significantly resist rotation of the rotating member 14.

As the wrap 16 is being dispensed, the user 100 may increase the tension in the film by clenching his or her hand and applying radially inward pressure or force to the holding member 12. The compression or radially inward force applied to the holding member 12 causes the inner surface 72 of the holding member 12 to frictionally engage the outer surface 28 of the engaging portion 26. In various aspects, the user can further apply radially inward force to the holding member 12 to slow down or stop rotation of the rotating member 14. Increasing the radially inward force to the holding member 12 increases the friction between the rotating member 14 and the holding member 12 due to the increased surface contact and pressure between the inner surface 72 of the holding member 12 and the outer surface 28 of the engaging portion 26 and causes the rotating member 14 to slow down or stop rotating altogether. This allows the user 100 to tension or stretch the wrap 16 when the user 100 holds the wrap dispenser 10 in place or continues to move the dispenser 10 with the roll of wrap 16. Thus, by the user 100 applying the appropriate radially inward pressure to the holding member 12, the wrap dispenser 10 is able to hold the wrap 16 taut around the object or objects being wrapped, preventing the unrolled wrap from becoming loose around the object or objects or during the dispensing.

In various aspects, the user 100 may cause the holding member 12 to slide longitudinally along the engaging portion until the first end 62 (shown in FIG. 6) of the holding member 12 frictionally engages the annular surface 54 (shown in FIG. 4) of the upset 50. In these aspects, the frictional engagement between the first end 62 of the holding member 12 and the annular surface 54 further causes the rotating member 14 to slow down or stop beyond merely the friction between the inner surface 72 of the holding member 12 and the outer surface 28 of engaging portion 26 caused by the compression of the holding member 12.

FIGS. 10-13 show a second aspect of the wrap dispenser 110. In the second aspect shown in FIG. 10, the wrap dispenser 110 includes a holding member 12 and a rotating member 114 having a roll of wrap 116 positioned over at least a part of the rotating member 114. In various aspects, the wrap 116 is rolled around the rotating member 114 to create the roll of wrap 116 shown in FIG. 10. The rotating member 114 is thereby a spool around which the wrap 116 is rolled.

The holding member 12 of the second aspect of the wrap dispenser 110 is the same as the holding member 12 of the first aspect of the wrap dispenser 10 shown in FIGS. 1-2, 6-8 and described above.

Figure 11:
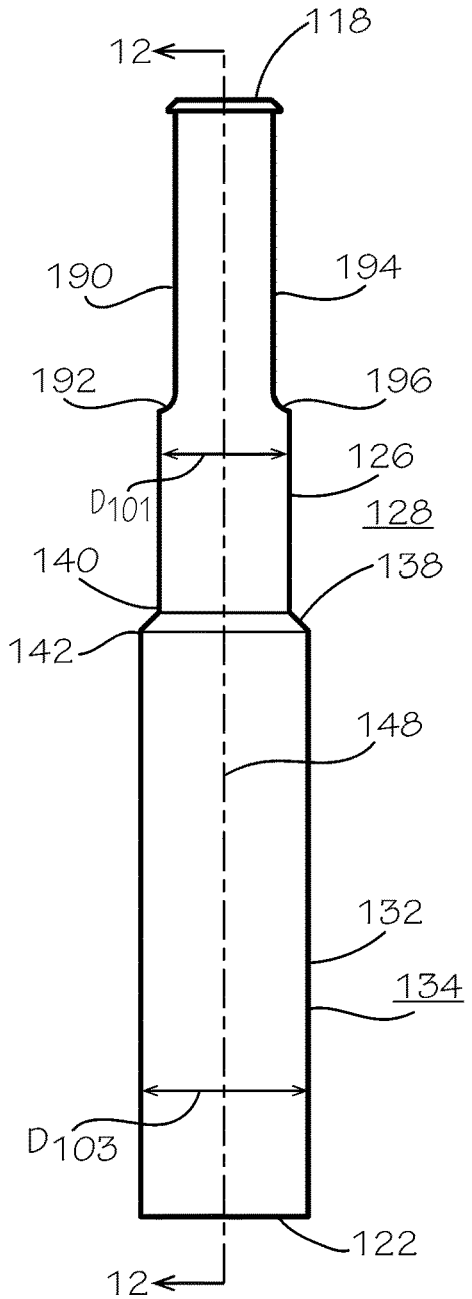
FIG. 11 is a side view of the rotating member of the wrap dispenser of FIG. 10.
Figure 12:
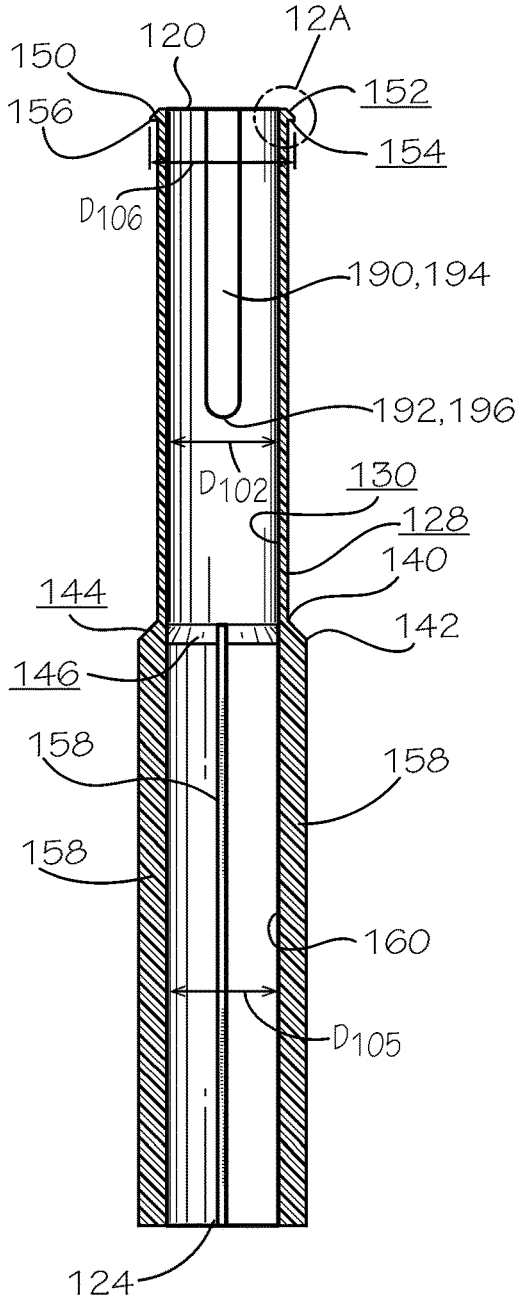
FIG. 12 is a cross-sectional view of the rotating member of FIG. 11 taken along line 12-12.
Figure 13:
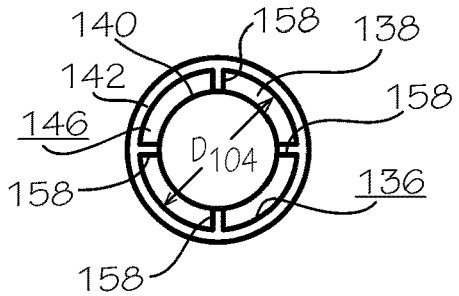
FIG. 13 is a bottom view of the rotating member of FIG. 11.

As shown in FIGS. 11-13, the rotating member 114 has a first end 118 defining a first opening 120 and a second end 122 defining a second opening 124 as well as an engaging portion 126, a roll-holding portion 132 and a transition portion 138 located laterally in between the engaging portion 126 and the roll-holding portion 132. In various aspects, the rotating member 114 is formed from a plastic material. In other various aspects, the rotating member can be formed from other rigid or semi-rigid materials, such as cast iron, steel, aluminum, titanium, copper, brass, resins, composites, or any material of sufficient strength to withstand the loads placed on it when dispensing film, or any combination of the foregoing materials.

The rotating member 114 has a longitudinal axis which is the axis of rotation 148 that extends from its first end 118 to its second end 122. The engaging portion 126 has a substantially annular or tubular configuration with a cylindrical outer surface 128 defining an outer diameter $D_{101}$ and a cylindrical inner surface 130 defining an inner diameter $D_{102}$. The outer diameter $D_{101}$ of the engaging portion is less than the diameter $D_9$ (shown in FIG. 7) of the inner surface 72 of the holding member 12 to provide clearance for the rotating member 114 to smoothly rotate relative to the holding member 12 when no substantial compression (or radially inward force) is applied to the holding member 12. The roll-holding portion 132 has a substantially annular or tubular configuration with a cylindrical outer surface 134 defining an outer diameter $D_{103}$ and a cylindrical inner surface 136 (shown in FIG. 13) defining an inner diameter $D_{104}$. The outer diameter $D_{103}$ of the roll-holding portion 132 is greater than the diameter $D_9$ (shown in FIG. 7) of the inner surface 72 of the holding member 12. The transition portion 138 has a first end 140 and a second end 142 and is longitudinally situated in between the engaging portion 126 and the roll-holding portion 132. The transition portion has a conical outer surface 144 with an outer diameter at the first end 140 equal to the outer diameter $D_{101}$ of the engaging portion 126 and an outer diameter at the second end 142 equal to the outer diameter $D_{103}$ of the roll-holding portion 132. The transition portion has a conical inner surface 146 (shown in FIGS. 12 and 13) with an inner diameter at the first end 140 equal to the inner diameter $D_{102}$ of the engaging portion 126 and an inner diameter at the second end 142 equal to the inner diameter $D_{104}$ of the roll-holding portion 132.

In various aspects, the outer surface 134 of the roll-holding portion 132 has a smooth surface. In various other aspects, the roll-holding portion 132 of the rotating member 114 includes at least one roll grip (not shown) on the outer surface 134. In these other aspects, the at least one roll grip is a rib or a raised surface protruding radially outward from the outer surface 134 on the roll-holding portion 132 of the rotating member 114. In these other aspects, the at least one roll grip engages the inside of the roll of wrap 116 in a frictionally desirable manner to help keep the roll of wrap 116 from sliding and/off or rotate independently of the rotating member 114.

Figure 12A:
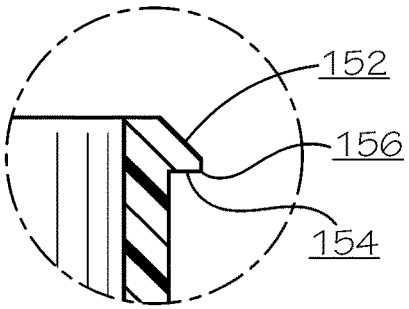
FIG. 12A is an enlarged view of portion 12A circled in FIG. 12.
Figure 14:
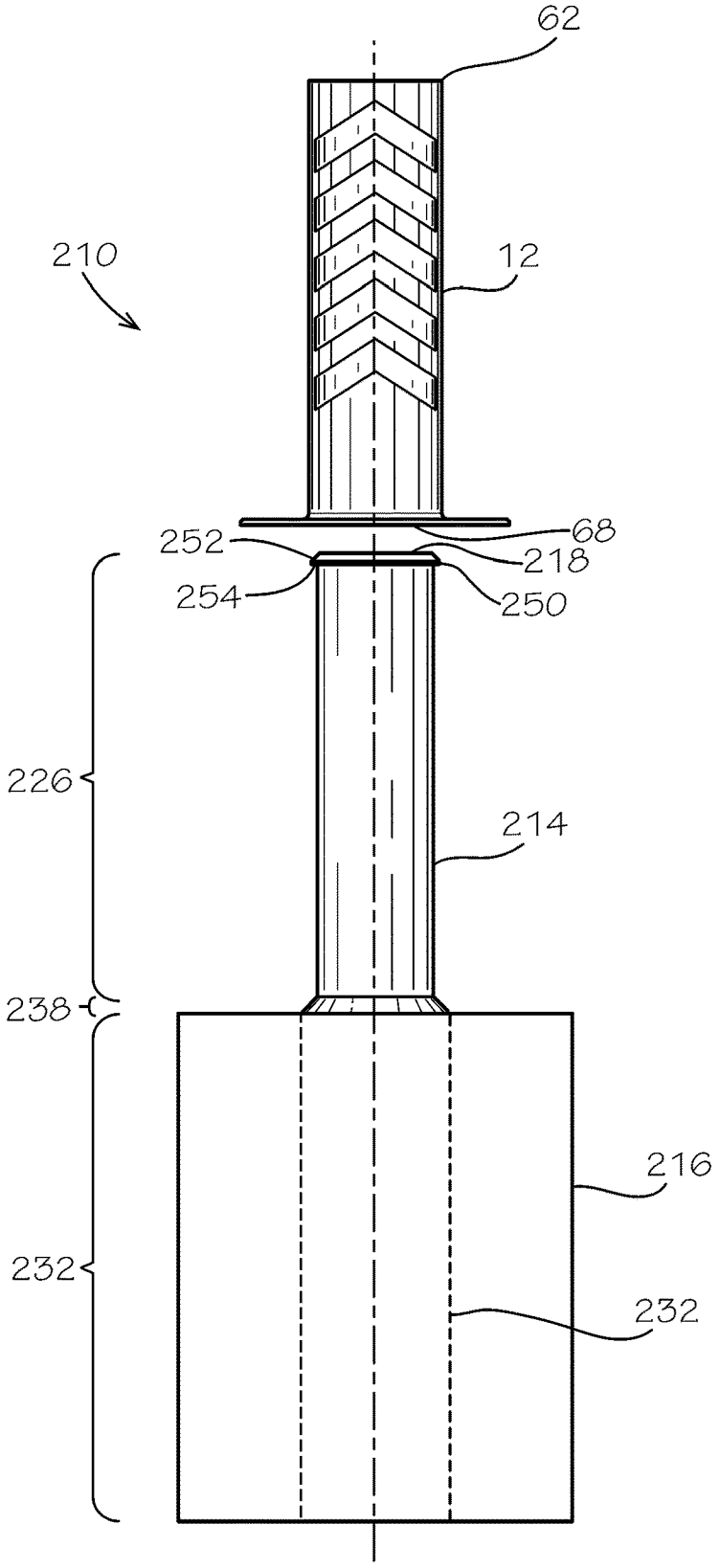
FIG. 14 is an exploded assembly view of the wrap dispenser according to a third aspect of the present disclosure showing how the rotating member and holding member are assembled.

The engaging portion 126 includes an upset 150 protruding radially outwardly from the cylindrical outer surface 128 of the engaging portion adjacent to the first end 118 of the rotating member 114. The upset 150 has a chamfered surface 152 and a flat annular surface 154 (shown in FIGS. 12 and 12A) substantially perpendicular to the cylindrical outer surface 128 of the engaging portion 126. The upset 150 has a radially outermost edge 156 at the intersection of chamfered surface 152 and the annular surface 154. The radially outermost edge 156 of the upset 150 has a diameter $D_{106}$. The diameter $D_{106}$ of the radially outmost edge 156 of the upset 150 is greater than the diameter $D_9$ (shown in FIG. 7) of the inner surface 72 of the holding member 12. In various aspects, the upset 150 is monolithically formed with the remainder of the engaging portion 126. Alternatively, in various other aspects, the upset can be separately formed pieces attached or otherwise connected to the remainder of the of the engaging portion 126 with mechanism, including, but not limited to, welding, adhesives, glues, fasteners, or various other attachment mechanisms.

The engaging portion 126 of the second aspect further defines two slots 190,194, each extending longitudinally from the first end 118 of the rotating member 114 to a rounded edge 192,196 located between the first end 118 and the transition portion 138 of the rotating member 114. The two slots 190,194 circumferentially disconnect the upset 150 of the second aspect such that the upset 150 does not define a continuous unbroken circle as the upset 50 of the first aspect. As to be discussed in greater detail below, the slots 190,194 allow the upset 150 to flex or compress radially inwardly to allow the holding member 114 to slide along the upset 150 with minimal radially outward expansion of the holding member 12.

The rotating member 114 has four substantially equally spaced ribs 158 (shown in FIGS. 12 and 13) extending radially inwardly from the cylindrical inner surface 136 (shown in FIG. 13) of the roll-holding portion 132 and the conical inner surface 146 of the transition portion 138. Each rib 158 has a radially inward edge 160 (shown in FIG. 12) that is substantially parallel to the longitudinal axis 148 of the rotating member 114. In various aspects, the radially inward edges 160 of the ribs 158 define a diameter $D_{105}$ equal to the inner diameter $D_{102}$ of the engaging portion 126, such that the smooth transition from the inner surface 130 of engaging portion 126 to the radially inward edges 160 of the ribs 158 minimalizes potential stress failures or cracks being formed at the transition. Furthermore, having the diameter $D_{105}$ of radially inward edges 160 of the ribs 158 equal to the inner diameter $D_{102}$ of the engaging portion 126 allows efficient molding of the rotating member by permitting the core of a die to be removed longitudinally along the axis 148 of the rotating member 114 through its second opening 124.

Referring back to FIG. 10, a method of assembling the wrap dispenser 110 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A holding member 12, a rotating member 114, and a wrap 116 are provided. In various aspects, the wrap 116 is wrapped directly around roll-holding portion 132 of the rotating member 114 to form the roll of wrap 116 positioned on the roll-holding portion 132.

The holding member 12 is positioned on engaging portion 126 of the rotating member 114 by inserting the engaging portion 126 of the rotating member 114 through and into the second opening 68 of the holding member 12 and further sliding the holding member 12 over the upset 150 of the engaging portion 126. Since the diameter $D_{106}$ (shown in FIG. 12) of the radially outermost edge 156 of the upset 150 is greater than the diameter $D_9$ (shown in FIG. 7) of the inner surface 72 of the holding member 12, the longitudinal slots 190,194 defined in the engaging portion 126 allow the upset 150 to be flexed, pushed or compressed radially inwardly to permit the holding member 12 to slide along the upset 150 with minimal expansion of the holding member 12. The chamfered surface 152 of the upset 150 causes the upset 150 to be flexed, pushed or compressed radially inwardly as the holding member 12 slides laterally along the chamfered surface 152. Once the holding member 12 has slid past the upset 150, the upset 150 springs radially outwardly back to a diameter that is larger than the diameter $D_9$ of the inner surface 72 of the holding member 12. In it installed position, wherein the first end 62 of the holding member 12 slid past the upset 150, the holding member 12 is laterally situated between the transition portion 138 of the rotating member 114 and the upset 150. Since the first end 62 of the holding member 12 now faces the flat annular surface 154, rather than a chamfered surface, the holding member 12 is not able to compress the upset 150 radially inwardly in the same manner as it was able to compress the upset 150 during installation.

In the installed position, the holding member 12 encloses at least a section of the engaging portion 126 of the rotating member 114 and the longitudinal axis 74 (shown in FIG. 6) of the holding member 12 is substantially aligned with the longitudinal axis 148 (shown in FIG. 11) of the rotating member 114. Furthermore, when the holding member 12 is fully installed onto the rotating member 114, the flange 76 at the second end 66 of the holding member is adjacent to the roll of wrap 116.

Figure 9:
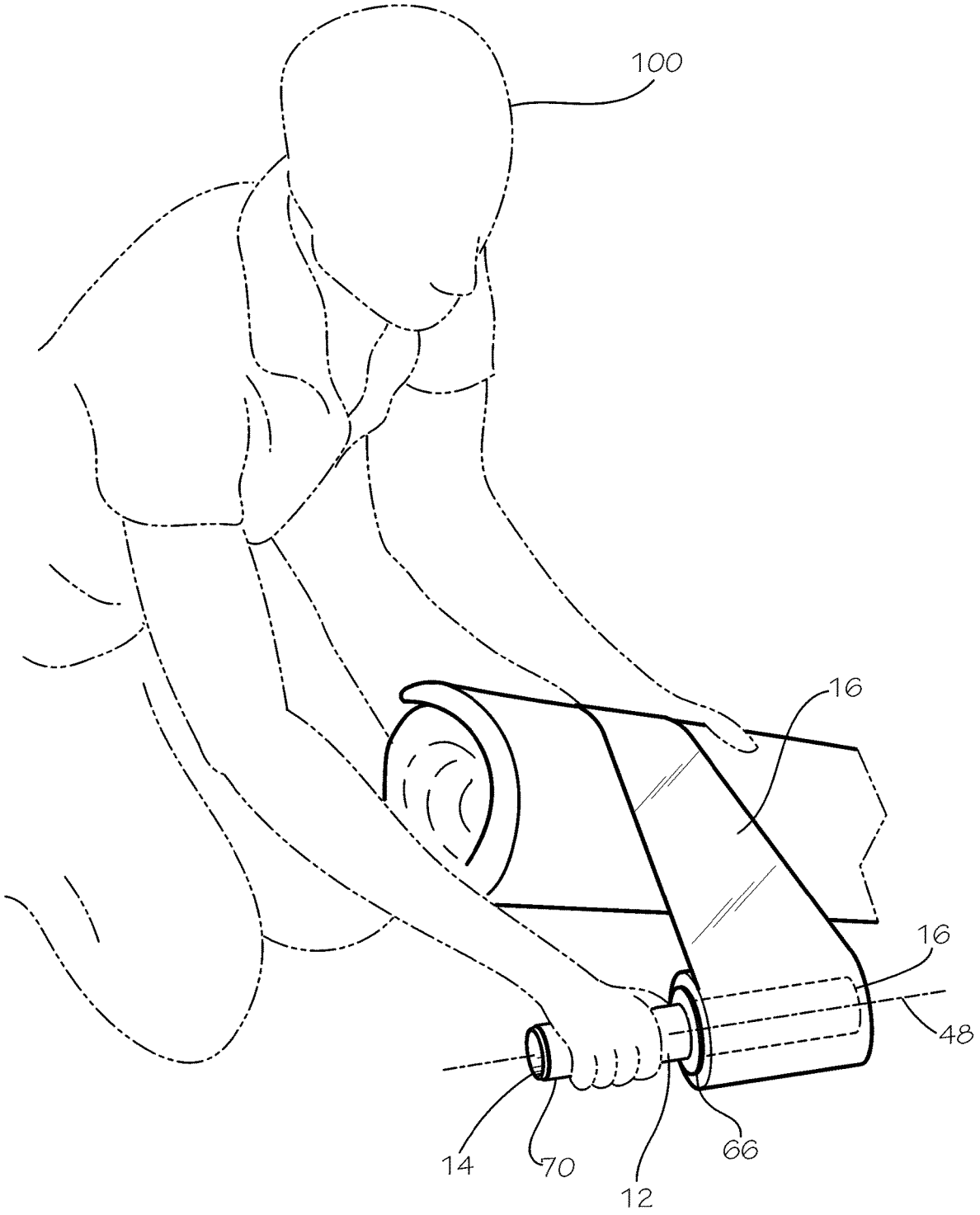
FIG. 9 is perspective view of the wrap dispenser of FIG. 1 being held and used by a user.
Figure 10:
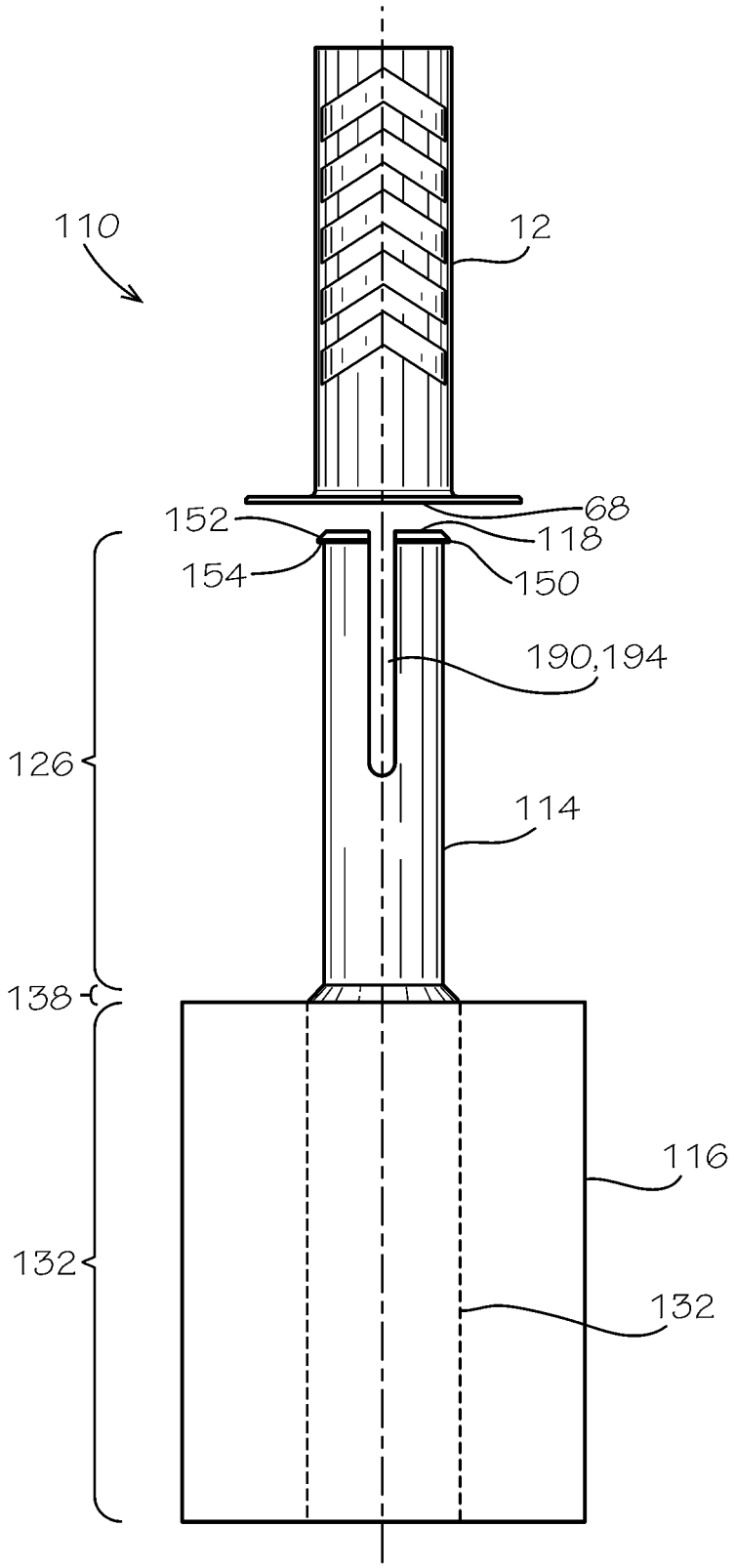
FIG. 10 is an exploded assembly view of the wrap dispenser according to a second aspect of the present disclosure showing how the rotating member and holding member are assembled.

The method of dispensing wrap 116 using a wrap dispenser 110 of the second aspect is the same as the method of dispensing wrap 16 using a wrap dispenser 10 of the first aspect shown in FIG. 9 and described in detail above. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure.

FIGS. 14-17 show a third aspect of the wrap dispenser 210. In the third aspect shown in FIG. 14, the wrap dispenser 210 includes a holding member 12 and a rotating member 214 having a roll of wrap 216 positioned over at least a part of the rotating member 214. In various aspects, the wrap 216 is rolled around the rotating member 214 to create the roll of wrap 216 shown in FIG. 14. The rotating member 214 is thereby a spool around which the wrap 216 is rolled.

The holding member 12 of the third aspect of the wrap dispenser 210 is the same as the holding member 12 of the first aspect of the wrap dispenser 10 shown in FIGS. 1-2, 6-8 and described above.

Figure 15:
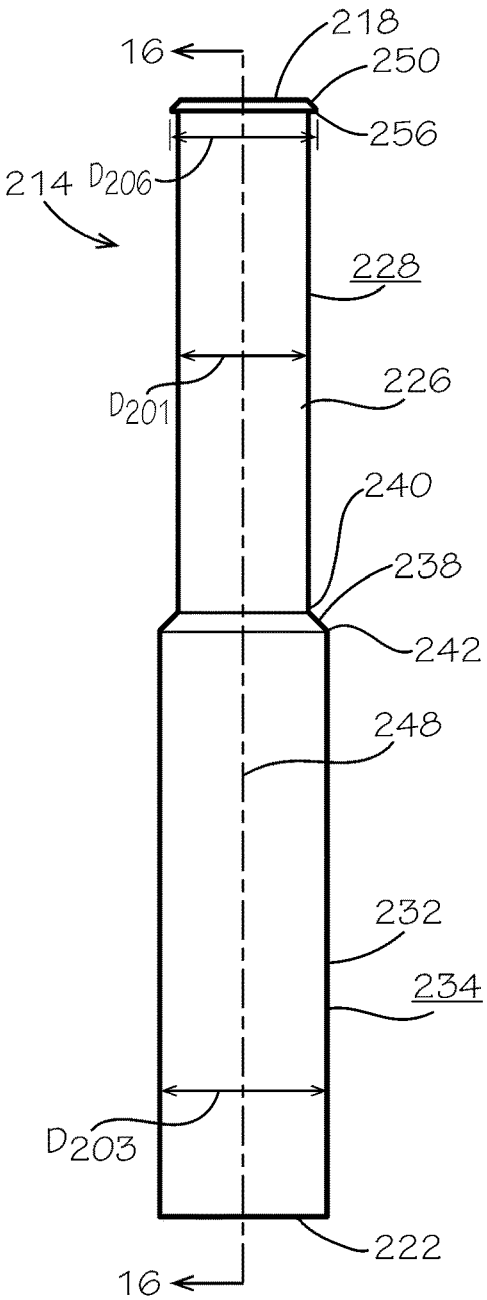
FIG. 15 is a side view of the rotating member of the wrap dispenser of FIG. 14.
Figure 16:
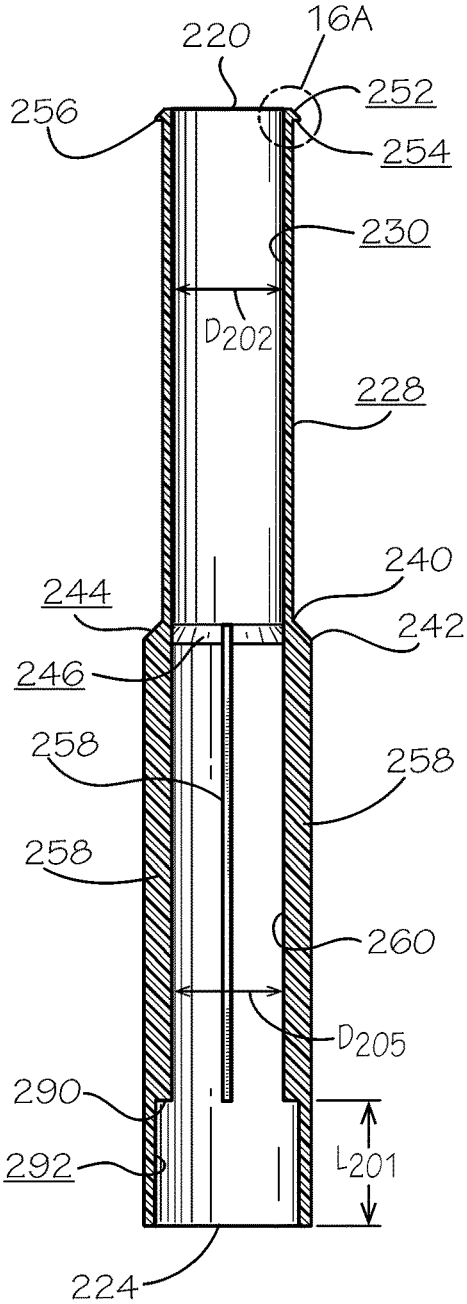
FIG. 16 is a cross-sectional view of the rotating member of FIG. 15 taken along line 16-16.
Figure 17:
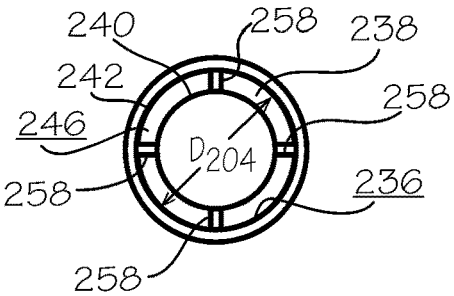
FIG. 17 is a bottom view of the rotating member of FIG. 15.

As shown in FIGS. 15-17, the rotating member 214 has a first end 218 defining a first opening 220 and a second end 222 defining a second opening 224 as well as an engaging portion 226, a roll-holding portion 232 and a transition portion 238 located laterally in between the engaging portion 226 and the roll-holding portion 232. In various aspects, the rotating member 214 is formed from a plastic material. In other various aspects, the rotating member can be formed from other rigid or semi-rigid materials, such as cast iron, steel, aluminum, titanium, copper, brass, resins, composites, or any material of sufficient strength to withstand the loads placed on it when dispensing film, or any combination of the foregoing materials.

The rotating member 214 has a longitudinal axis which is the axis of rotation 248 that extends from its first end 218 to its second end 222. The engaging portion 226 has a substantially annular or tubular configuration with a cylindrical outer surface 228 defining an outer diameter $D_{201}$ and a cylindrical inner surface 230 defining an inner diameter $D_{202}$. The outer diameter $D_{201}$ of the engaging portion is less than the diameter $D_9$ (shown in FIG. 7) of the inner surface 72 of the holding member 12 to provide clearance for the rotating member 214 to smoothly rotate relative to the holding member 12 when no substantial compression (or radially inward force) is applied to the holding member 12. The roll-holding portion 232 has a substantially annular or tubular configuration with a cylindrical outer surface 234 defining an outer diameter $D_{203}$ and a cylindrical inner surface 236 (shown in FIG. 17) defining an inner diameter $D_{204}$. The outer diameter $D_{203}$ of the roll-holding portion 232 is greater than the diameter $D_9$ (shown in FIG. 7) of the inner surface 72 of the holding member 12. The transition portion 238 has a first end 240 and a second end 242 and is longitudinally situated in between the engaging portion 226 and the roll-holding portion 232. The transition portion has a conical outer surface 244 with an outer diameter at the first end 240 equal to the outer diameter $D_{201}$ of the engaging portion 226 and an outer diameter at the second end 242 equal to the outer diameter $D_{203}$ of the roll-holding portion 232. The transition portion has a conical inner surface 246 (shown in FIGS. 16 and 17) with an inner diameter at the first end 240 equal to the inner diameter $D_{202}$ of the engaging portion 226 and an inner diameter at the second end 242 equal to the inner diameter $D_{204}$ of the roll-holding portion 232.

In various aspects, the outer surface 234 of the roll-holding portion 232 has a smooth surface. In various other aspects, the roll-holding portion 232 of the rotating member 214 includes at least one roll grip (not shown) on the outer surface 234. In these other aspects, the at least one roll grip is a rib or a raised surface protruding radially outward from the outer surface 234 on the roll-holding portion 232 of the rotating member 214. In these other aspects, the at least one roll grip engages the inside of the roll of wrap 216 in a frictionally desirable manner to help keep the roll of wrap 216 from sliding and/off or rotate independently of the rotating member 214.

Figure 16A:
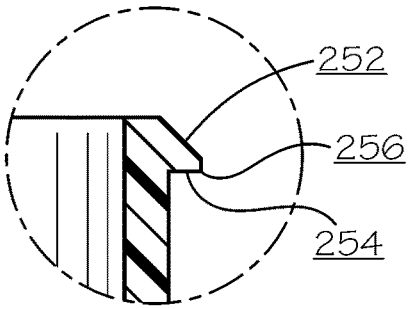
FIG. 16A is an enlarged view of portion 16A circled in FIG. 16.

The engaging portion 226 includes an upset 250 protruding radially outwardly from the cylindrical outer surface 228 of the engaging portion adjacent to the first end 218 of the rotating member 214. The upset 250 has a chamfered surface 252 and a flat annular surface 254 (shown in FIGS. 16 and 16A) substantially perpendicular to the cylindrical outer surface 228 of the engaging portion 226. The upset 250 has a radially outermost edge 256 at the intersection of chamfered surface 252 and the annular surface 254. The radially outermost edge 256 of the upset 250 has a diameter $D_{206}$. The diameter $D_{206}$ of the radially outmost edge 256 of the upset 250 is greater than the diameter $D_9$ (shown in FIG. 7) of the inner surface 72 of the holding member 12. In various aspects, the upset 250 is monolithically formed with the remainder of the engaging portion 226. Alternatively, in various other aspects, the upset can be separately formed pieces attached or otherwise connected to the remainder of the of the engaging portion 226 with mechanism, including, but not limited to, welding, adhesives, glues, fasteners, or various other attachment mechanisms.

The rotating member 214 has four substantially equally spaced ribs 258 (shown in FIGS. 16 and 17) extending radially inwardly from the cylindrical inner surface 236 (shown in FIG. 17) of the roll-holding portion 232 and the conical inner surface 246 of the transition portion 238. Each rib 158 has a radially inward edge 260 (shown in FIG. 16) that is substantially parallel to the longitudinal axis 248 of the rotating member 214. Each rib 258 extends longitudinally away from the transition portion 238 and terminates at an edge 290 located a given distance $L_{201}$ from the second end 222 of the rotating member 214. The portion of the cylindrical inner surface 236, located between the edges 290 of the ribs 158 and the second end 222, defines a smooth cylindrical surface 292 having a diameter $D_{204}$. The smooth cylindrical surface 292, absent any ribs, allows the rotating member 214 to nest correctly on a corresponding machine during the manufacturing of the rotating member and/or the assemblage of the wrap dispenser 210. In various aspects, the radially inward edges 260 of the ribs 258 define a diameter $D_{205}$ equal to the inner diameter $D_{202}$ of the engaging portion 226, such that the smooth transition from the inner surface 230 of engaging portion 226 to the radially inward edges 260 of the ribs 258 minimalizes potential stress failures or cracks being formed at the transition. Furthermore, having the diameter $D_{205}$ of radially inward edges 260 of the ribs 258 equal to the inner diameter $D_{202}$ of the engaging portion 226 allows efficient molding of the rotating member by permitting the core of a die to be removed longitudinally along the axis 248 of the rotating member 214 through its second opening 224.

Referring back to FIG. 14, a method of assembling the wrap dispenser 210 is described in further detail. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure. A holding member 12, a rotating member 214, and a wrap 216 are provided. In various aspects, the wrap 216 is wrapped directly around roll-holding portion 232 of the rotating member 214 to form the roll of wrap 216 positioned on the roll-holding portion 232.

The holding member 12 is positioned on engaging portion 226 of the rotating member 214 by inserting the engaging portion 226 of the rotating member 214 through and into the second opening 68 of the holding member 12 and further sliding the holding member 12 over the upset 250 of the engaging portion 226. Since the diameter $D_{206}$ (shown in FIG. 15) of the radially outermost edge 256 of the upset 250 is greater than the diameter $D_9$ (shown in FIG. 7) of the inner surface 72 of the holding member 12, the holding member 12 will need to expand and stretch radially outwardly as it slides along the upset 250. The chamfered surface 252 of the upset 250 guides the expansion or stretching of the holding member 12 radially outwardly as the holding member 12 slides laterally along the chamfered surface 252. Once the holding member 12 has slid past the upset 250, the holding member 12 contracts back to a diameter that is smaller than the diameter $D_{206}$ of the radially outermost edge 256 of the upset 250. In its installed position, wherein the first end 62 of the holding member 12 slid past the upset 250, the holding member 12 is laterally situated between the transition portion 238 of the rotating member 214 and the upset 250. Since the first end 62 of the holding member 12 now faces the flat annular surface 254 of the upset 250, rather than a chamfered surface, the holding member 12 is not able to slide over the upset 250 in the same manner as it was able to slide over the chamfered surface 252 during installation.

In the installed position, the holding member 12 encloses at least a section of the engaging portion 226 of the rotating member 214 and the longitudinal axis 74 (shown in FIG. 6) of the holding member 12 is substantially aligned with the longitudinal axis 248 (shown in FIG. 15) of the rotating member 214. Furthermore, when the holding member 12 is fully installed onto the rotating member 214, the flange 76 at the second end 66 of the holding member is adjacent to the roll of wrap 216.

The method of dispensing wrap 216 using a wrap dispenser 210 of the third aspect is the same as the method of dispensing wrap 16 using a wrap dispenser 10 of the first aspect shown in FIG. 9 and described in detail above. It should be noted that any of the steps of any of the methods described herein may be performed in any order or could be performed in sub-steps that are done in any order or that are separated in time from each other by other steps or sub-steps, and the disclosure of a particular order of steps should not be considered limiting on the current disclosure.

This assembly configuration represents one of many possible assembly configurations. One skilled in the art will understand that obvious variations of this assembly configuration are included within this disclosure, including variations of steps, combinations of steps, and dissections of steps, among others. Where materials are chosen for the elements of this assembly, particularly rubber, metal, and plastic, similar material choices may also be used and would be obvious to one in the art. In particular, the rotating member 14,114,214 and/or holding member 12 is constructed from the group including, but not limited to cast iron, steel, aluminum, titanium, copper, brass, various plastics, resins, composites, or any material of sufficient strength to withstand the loads placed on them when dispensing film or other wrap materials from a roll but resilient enough to allow compression of the holding member 12 to frictionally engage the rotating member 14,114,214, or any combination of the foregoing materials. In particular, in various aspects, the holding member 12 and the rotating member 14,114,214 are made from plastic. In various other aspects, the holding member 12 may be made from a rubber-like material and the rotating member 14,114,214 is made from composites. Furthermore, the configuration of either member need not be annular but could be another configuration depending on the application. Finally, additional members may be added to the wrap dispenser 10,110,210 and various components may be split into other components. For one example among others, an elastomeric component may be applied to the outer holding surface 70 of the holding member 12 to aid in grip. In such a case, the elastomeric component would be considered a portion of the holding member 12. This elastomeric component could be added to a plastic holding member 12 using molding technology or methods known in the art.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect. It should be emphasized that the above-described aspects are merely possible examples of implementations, merely set forth for a clear understanding of the principles of the present disclosure. Many variations and modifications can be made to the above-described aspect(s) without departing substantially from the spirit and principles of the present disclosure. All such modifications and variations are intended to be included herein within the scope of the present disclosure, and all possible claims to individual aspects or combinations of elements or steps are intended to be supported by the present disclosure. Moreover, although specific terms are employed herein, as well as in the claims which follow, they are used only in a generic and descriptive sense, and not for the purposes of limiting the present disclosure, nor the claims which follow.

That which is claimed is:

1. A dispenser comprising:

a rotating member including a first portion and a second portion, the first portion having an outer surface and a cylindrical inner surface defining a diameter, the second portion having an outer surface and a cylindrical inner surface defining a diameter, wherein the diameter of the cylindrical inner surface of the second portion is greater than the diameter of the cylindrical inner surface of the first portion, a plurality of ribs extending radially inwardly from the cylindrical inner surface of the second portion, each of the ribs defining a free radially inward edge; and a holding member located radially outwardly of the first portion, the holding member having an inner surface and an outer surface.

2. The dispenser of claim 1, wherein the free radially inward edges define a diameter equal to the diameter of the cylindrical inner surface of the first portion.

3. The dispenser of claim 1, wherein the holding member is configured to allow the holding member to rotate relative to the rotating member and to allow the holding member to frictionally engage the rotating member upon radially inward force applied to the holding member.

4. The dispenser of claim 1, wherein the outer surface of the holding member includes a plurality of indentions.

5. The dispenser of claim 1, wherein the rotating member has an upset protruding radially outwardly from the outer surface of the first portion, the holding member located longitudinally between the upset and the second portion.

6. The dispenser of claim 5, wherein the upset includes a chamfered surface and an annular flat surface.

7. The dispenser of claim 5, wherein the upset defines a diameter greater than a diameter defined by the inner surface of the holding member.

8. The dispenser of claim 7, wherein the upset is circumferentially continuous.

9. The dispenser of claim 7, wherein the first portion of the rotating member defines a slot extending longitudinally through the upset.

10. The dispenser of claim 1, wherein the holding member includes a radially outwardly extending flange at an end.

11. The dispenser of claim 1, wherein the rotating member includes a third portion located laterally between the first portion and the second portion, the third portion having a conical outer surface, and wherein each rib extends to an inner surface of the third portion.

12. The dispenser of claim 1, wherein the rotating member has a first end defined at the first portion and a second end defined at the second portion, and each rib has a terminal edge located a distance from the second end.

13. A dispenser comprising:

a rotating member including a first portion having an outer surface and a cylindrical inner surface defining a diameter, a second portion having an outer surface and a cylindrical inner surface defining a diameter, the diameter of the cylindrical inner surface of the second portion is greater than the diameter of the cylindrical inner surface of the first portion, a third portion having a conical outer surface and an inner surface, a plurality of ribs extends radially inwardly from inner surfaces of the second and third portions; and a roll of wrap located radially outwardly of the outer surface of the second portion.

14. The dispenser of claim 13, wherein the plurality of ribs has radially inward edges defining a diameter equal to the diameter of cylindrical inner surface of the first portion.

15. The dispenser of claim 14 further comprises a holding member located radially outwardly of the first portion.

16. The dispenser of claim 15, wherein the rotating member has an upset extending radially outward from the outer surface of the first portion, the holding member located longitudinally between the upset and the second portion.

17. A method of assembling a wrap dispenser comprising the steps of:

providing a rotating member including a first portion and a second portion, the first portion having an outer surface and a cylindrical inner surface defining a diameter, the second portion having an outer surface and a cylindrical inner surface defining a diameter, wherein the diameter of the cylindrical inner surface of the second portion is greater than the diameter of the cylindrical inner surface of the first portion, a plurality of ribs extending radially inwardly from the cylindrical inner surface of the second portion, each of the ribs defining a free radially inward edge;

providing a holding member having an inner surface, an outer surface, and an opening; and inserting the first portion of the rotating member through the opening of the holding member.

18. The method of claim 17, wherein the first portion of the rotating member has an upset extending radially outwardly from the outer surface of the first portion and the upset has a diameter greater than the diameter of the inner surface of the holding member, and wherein the step of inserting the first portion of the rotating member through the opening of the holding member includes sliding the holding member over the upset.

19. The method of claim 18, wherein the upset is circumferentially continuous, and wherein the step of sliding the holding member over the upset includes stretching the holding member radially outwardly as the holding member slides over the upset.

20. The method of claim 18, wherein the first portion of the rotating member defines a slot extending axially through the upset, and wherein the step of sliding the holding member over the upset includes compressing the upset radially inwardly as the holding member slides over the upset.

* * * * *